United States Patent [19]

Hupkes et al.

[11] 4,195,675

[45] Apr. 1, 1980

[54] SHAVING WOOD

[76] Inventors: Hendrik Hupkes, Gaasterland 30, Zoetermeer; Henk Hupkes, Burr. van Cordstraat 12, Ermelo, both of Netherlands

[21] Appl. No.: 955,521

[22] Filed: Oct. 30, 1978

Related U.S. Application Data

[63] Continuation of Ser. No. 783,065, Mar. 30, 1977, abandoned.

[30] Foreign Application Priority Data

Apr. 2, 1976 [NL] Netherlands ..... 7603436

[51] Int. Cl.[2] ..... B27C 1/14; B27L 11/00

[52] U.S. Cl. ..... 144/120; 144/198 R; 144/323

[58] Field of Search ..... 144/120, 162, 198, 114, 144/323, 309 R, 175

[56] References Cited

U.S. PATENT DOCUMENTS

| | | | |
|---|---|---|---|
| 1,696,584 | 12/1928 | Schwer | 145/5 R |
| 1,703,007 | 2/1929 | Johnson | 144/120 |
| 3,783,917 | 1/1974 | Mochizuki | 144/120 |

FOREIGN PATENT DOCUMENTS

| | | | |
|---|---|---|---|
| 1292286 | 3/1962 | France | 144/120 |

*Primary Examiner*—Donald R. Schran
*Attorney, Agent, or Firm*—Daniel M. Rosen

[57] ABSTRACT

Method and apparatus for shaving wood using stationary, i.e. non-rotary cutting tools, wherein the aids such as a top iron and/or a front table can be optimally adjusted so that a rive crack of a desired length is produced corresponding to each cutting depth selected.

12 Claims, 6 Drawing Figures

SHAVING WOOD

This is a continuation of application Ser. No. 783,065, filed Mar. 30, 1977, now abandoned.

BACKGROUND OF THE INVENTION

This invention relates to a method of shaving anisotropic and/or inhomogeneous materials such as wood, wherein a cutter coacts with one or more aids, namely a front table or a pressure bar, on the one hand, and/or a top iron on the other.

The conventional milling and moulding machines, for shaving wood all have certain serious drawbacks which are caused by the use of rotary cutter blocks. The major drawbacks are (a) the treated surface shows a machine stroke if a better surface quality is to be achieved, either the feeding speed of the material to be worked should be reduced or an additional after-treatment has to take place by means of an expensive scouring process, or additionally a thin chip has to be removed by means of a machine operating through non-rotary cutters, such as a fixed-knife box;

(b) there is high power consumption per unit area of treated surface and high idling capacity;

(c) there is significant danger, owing to both the possibility of hawk-in or kick-back of materials and the great centrifugal forces which arise and (d) there is an intolerable noise level.

It is obvious to try to eliminate the above drawbacks by using instead of rotary cutter blocks, non-rotary knives, as to be found for instance in knife boxes and block planes. However, practice has shown that the use of non-rotary knives involves other drawbacks, which are so serious that wood treating machines with rotary cutter blocks are still predominantly in use.

The drawbacks inherent in using stationary knives lie mainly in the field of adjustment of the tool when thick chips or chips of different thickness have to be removed.

When a chip has to be removed by means of a stationary knife, not only the cutting tool has to be set to the proper depth, but also the so-called aids namely the top iron and/or the front table or the pressure bar have to be set. These aids, individually or in combination, serve to force the removed chip to describe a specific path with a centre of curvature specifically defined by the position of said aids also by means of these aids the length of the rive crack being formed ahead of the cutter is defined. Since the control of the length of said rive crack is highly important for obtaining a worked surface of high quality, also a proper setting of an aid or the aids, is very important.

In this respect it is observed that when use is made of a pressure bar or block in connection with the instant method, said pressure bar has the same function as the front table. A pressure bar is a body which exerts pressure on the object to be worked, ahead of the cutter. Also by means of a pressure bar the length of the rive crack is limited.

The setting of the cutting tool to the desired chip thickness is effected in a known manner, e.g. by means of so-called sole or table adjustment, in the case of a block plane. Adjustment may also be effected using as the reference surface, a surface other than the one to be worked; for instance as a reference face, the face of the work opposite to the surface to be worked may be used.

In particular, the adjustment of the aids is very critical when relatively thick chips have to be removed. The rigidity of a chip as a matter of fact is proportional to the cube power of its thickness; this has the result with thick chips, that in case of incorrect adjustment of one or more aids, the removed chip "gets stuck", because a long rive crack is produced, as a result of which the surface to be worked can be easily spoiled.

Generally speaking, it may be stated that planing tools having stationary, i.e. non-rotary cutters are suitable for removing relatively thin chips, and that with increasing chip thickness, the difficulties encountered during the setting increase enormously. The result is that this type of tools has many drawbacks when used for removing thick chips or for removing chips whose thickness has to be variably adjustable.

It is observed in this respect that the optimal adjustment of the aids can only be successfully effected by skilled workers, and that even then the result has to be checked mostly by means of test planing.

It is the object of the invention to eliminate the above mentioned drawbacks which occur during planing by means of tools having non-rotary cutters, thereby to create the possibility of using stationary cutters for performing working steps hitherto effected by means of rotary cutter blocks.

SUMMARY OF THE INVENTION

The method according to the invention is characterized in that the cutter is set to a depth which corresponds to a desired chip thickness and that, coupled therewith, an aid is so adjusted that the centre of curvature of the path traversed by the removed chip always lies on a line of which each point leads to an optimal rive crack associated with the respective chip thickness.

As a result of, for instance, a mechanical coupling between the cutting tool and the aid(s), it has been found possible to adjust the tool in a very simple manner for each desired chip thickness. Care must be taken that this coupling is performed so that there is obtained with each chip thickness an optimal rive crack, i.e. only just tolerable as regards length, in connection with the quality of the surface to be worked, on the one hand, and wear on the cutter and power consumption, on the other. In particular this is important when removing thick chips. Skill and/or checking of the setting by means of a test are not required with the method according to the invention.

As already observed, the above coupling should be such that for each chip thickness the centre of curvature of the path of the removed chip lies on a predetermined line—the locus of the centres of curvature. It is known that for obtaining the desired result, the position of the top iron, i.e. the free cutting face width and top iron angle and/or the distance between the cutting face of the cutting tool and the front table edge, or the pressure bar—the gap width—, are of essential importance.

The new concept selecting as the path of adjustment for e.g. the top iron, a specific, for instance straight, path or adjustment, and incorporating same as a standard path of adjustment when working a specific material in the working process, while coupling same to the depth adjustment of the cutting tool in this manner, there is no longer a question of elaborate adjustment, while yet an optimum result is achieved this is considered a surprising development in the domain of planing by means of stationary cutters. The method according to the invention thus opens new ways in this field of technology.

One embodiment of the method according to the invention wherein use is made of aids such as a front table and a top iron, is characterized adjustment for a desired chip thickness is effected by adjusting the cutting tool, starting from a position of the cutting tool in which it barely does not remove a chip, and maintaining a constant or substantially constant rake angle. The tool point follows an adjustment path that is positioned in the acute angle between the bisector of the angle between the sole of the front table and the cutting face of the tool and the sole of the front table, or in the opposite angle. Accordingly the legs of the angle may be displaced in parallel relationship over a distance corresponding to the spring-back, and simultaneously therewith the top iron is co-adjusted at a constant or substantially constant top iron angle along such a path of adjustment as to comply with the requirements set with respect to the centre of curvature.

The adjustment path of the cutting tool lies within the above described angle; this is established by the condition that, when chip thickness is increasing, the gap width should at least be equal to the chip thickness.

Shaving takes place only when the set depth of the cutting tool exceeds a specific value which is characteristic of the material to be worked—the spring-back—. Each material has spring back. This means that in the definition of the opposing acute angles, within which the path of adjustment of the tool point should lie, the definition should include the requirement that the legs of said angles are displaced in mutually parallel relationship, depending on the material to be worked. It is observed that the path of adjustment of the tool point may be a straight line, a concave or convex curve or any combination.

The above described methods may be performed with specially designed tools wherein the paths of adjustment of the cutting tool and those of either the front table or pressure bar, or the top iron, or both are so coupled together that the required optimum rive crack is always produced. For instance, a planing tool which, like a conventional block plane, comprises a front and a back table and a top iron, abutting against the cutting tool under a certain pressure, has the following characteristics for the performance of the method according to the invention: the cutting tool lip is adjustable at a constant angle with the sole of the front table—so that the rake angle is constant—along a path of adjustment that is located between the outer bisector of the angle between the sole of the front table and the face of the tool lip and the plane of the sole of the front table; the top iron always abuts against the face of the tool lip at a constant or substantially constant angle and is adapted for movement aong said face. The adjustment paths of the cutting tool and the top iron therefore are coupled to each other in such a way that the straight path of adjustment of the cutting tool leads to a straight or substantially straight path of adjustment of the top iron. The interrelationship between the two adjustment path directions is fixed for each planing tool and therefore is a given data for each plane. How this interrelationship is selected depends on the material to be worked.

A preferred embodiment of such a plane according to the invention has the feature that the tool is fixedly connected to the back table which is slidingly adjustable in a direction corresponding with that of the path of adjustment of the tool; a rear block is fixedly connected to the front table, and the top iron is attached to a tilting arm, pivoting around a pin connected to the rear block, whereby it rests against the cutting face of the tool with an adjustable clamping force, e.g. by means of a resilient element.

By virtue of the attachment of the cutting tool to the back table, so that the tool is set by adjusting the back table, the advantage of greater accuracy of adjustment is obtained. The attachment of the top iron to a tilting arm by means of which also the clamping force with which the top iron is always pressed against the cutting tool is transferred, is a simple and effective construction, ensuring a proper adjustment of the top iron. The clamping force, too, can be adjusted in a simple manner. It is true that the top iron does not move exactly at a constant angle, but since the radius of the circle along which the tool edge is moving is so much larger than the path traversed over the circle circumference, the deviation does not affect the required setting, i.e., the position of the centre of curvature of the path which is followed by the removed chip.

An advantageous suspension of the pivot pin is achieved by so designing the pin that in the absence of clamping force, the tilting arm can be removed and re-assembled, while maintaining the adjustment of the top iron relative to the tool. The advantage of this feature is that the tilting arm and the pivot pin can be easily removed. When the tool is exchanged, the initial setting of the top iron is thus maintained.

In order to set the cutting tool properly for a specific cutting depth, there is provided, according to a further feature of the invention, a vernier scale at the face of the tool along which the back table and the rear block can slidingly move relative to one another. This graduation is calibrated with respect to the thickness of the removed chip. In this calibration allowance is made for the so-called spring-back of the surface to be worked. In order that the proper zero position can be easily set, i.e. the position wherein barely no chip is removed, a tool of the above type is preferably provided at the sliding surface between the back table and the rear block with a scale having one or more marks which correspond to a setting of the back table relative to the front table, corresponding to the occurring spring-backs, such that the tool point lies in the plane of the sole of the front table. These spring-backs of the surface to be worked differ from material to material. For instance, wet deal may have a spring-back of 0.09 mm, while this value is 0.03 mm for dry oak.

The back table and the rear block have abutting faces kept against each other by means of one or more resilient elements by means of which they slide along one another according to another feature of the invention. The advantage of this feature is that no locking or unlocking is required during the setting. Although only tools have been mentioned in the foregoing for working plane surfaces, the invention also applies to tools for obtaining profiled surfaces.

The invention also comprises wood working machines wherein one or more tools according to the invention are employed. For instance, this applies to machines wherein for each operation a plurality of planes are positioned one behind the other. In such machines the "first" planes, which are roughing planes, should never produce a rive crack penetrating into the surface to be eventually obtained: the last plane defines the smoothness of the surface. The invention also comprises multiple planing machines by means of which both profiled and non-profiled surfaces are realized.

Some embodiments of the invention will now be explained, by way of example, with reference to the accompanying drawings:

BRIEF DESCRIPTION OF THE DRAWINGS

In the Figures corresponding parts, angles etc. are designated by identical reference numerals.

DETAILED DESCRIPTION OF THE PREFERRED EMBODIMENTS

Figure 1:
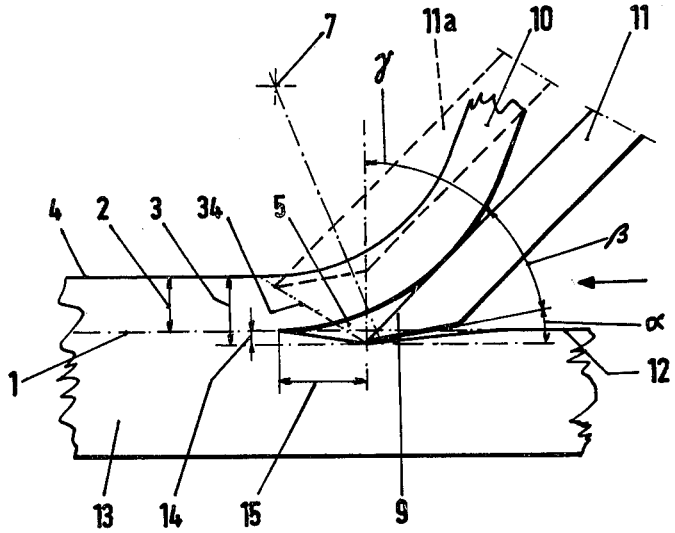
FIGS. 1, 2, 3 and 4 diagrammatically show the shaving of e.g. wood without an aid and using as an aid a top iron, a front table and a pressure bar, respectively.

FIG. 1 shows a method of removing a chip, wherein by means of a cutting tool 11, which moves relatively to the wood in the direction of the arrow, a chip 10 is removed from a piece of wood 13. The purpose is to obtain a worked surface 12, starting from the unmachined or roughly-machined surface 4.

Wood has the property that it springs back after having been machined. When the cutting tool is set to remove a chip 10 having a desired thickness 2, allowance should be made for said spring-back 14. In the zero-setting, which is the setting at which the cutting tool just does not remove a chip—corresponding to the dotted position of the cutting tool 11*a*—said spring-back can be found back in the depth at which the tool point is positioned underneath the surface 4 to be worked. Starting from said surface 4, the set depth 3 of the tool therefore is equal to the thickness 2 of the removed chip 10, increased by said spring-back 14.

For setting the tool 11 to the required depth, it is adjusted over e.g. the path of adjustment 34, of which the vertical component, calculated from the zero setting, is equal to the thickness 2 of the removed chip 10. By 1 is indicated the imaginary surface obtained by extending the worked surface 12. It is observed that surfaces 1, 4 and 12 are not necessarily plane faces. They may also be curved surfaces with for instance a circular cross-section. Characteristic of the position of the cutting tool are the clearance angle $\alpha$, the wedge angle $\beta$ and the rake angle $\gamma$. Ahead of the tool lip there is produced a rive crack 5 having a length 15. For the sake of clarity of these considerations, the path of the removed chip is always assumed to be circular. This assumption turns out to lead to acceptable results in practice.

The centre 7 of the path followed by the removed chip 10 will lie "somewhere" on the bisector of the angle between the imaginary extended worked surface 12—i.e. the face 1—and the face 9 of the tool 11. By this, the location of said centre of curvature 7 is not precisely defined. Since the length 15 of the rive crack 5 is defined by the position of said centre of curvature, likewise the length of the rive crack 5 is indefinite.

It is known that the machining can be influenced by varying the rake angle $\gamma$. Starting from a small rake angle, and gradually increasing same, there is first produced a so-called deformed chip with no occurrence of a rive crack. The required cutting force with this small angle $\gamma$ is considerable and likewise there is a substantial wear on the cutting edge of the tool. With an increasing rake angle $\gamma$, the chip form passes into a stripped chip, in which case a rive crack is barely produced. The required cutting force is smaller and the tool wear is less. Upon a further increase of the rake angle, there occurs a rive crack, during which the resulting surface 12 is no longer substantially defined by the tool, but also the arbitrariness during the splitting plays a role so that the surface quality may be effected.

Preferably the work is done in the range of riven chips as close as possible to the range where stripped chips occur. The setting of the tool in the above preferred range is very difficult owing to the many variables which play a role.

Since the rive crack formation strongly depends on the rigidity of the chip and said rigidity increases with the cube power of the thickness of the chip, it is not possible to remove thick chips, by means of only one tool, and yet obtain a smoothly worked surface except by using aids.

Figure 2:
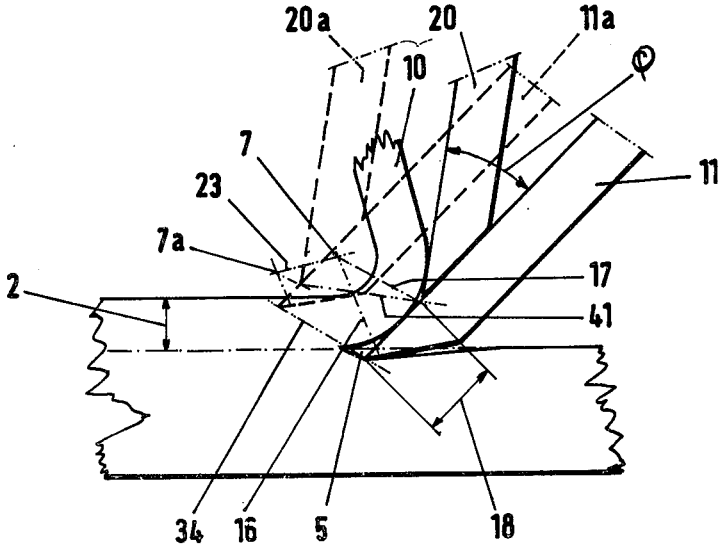

FIG. 2 diagrammatically shows how a chip 10 may be removed using a top iron 20. The position of the top iron is defined by the iron angle $\phi$ and the free cutting face width 18. When the path of the removed chip 10 is again assumed to be circular, the location of the centre of curvature 7 of the path of the removed chip is determined when top iron 20 and cutting tool 11 have a given position; said centre 7 as a matter of fact lies on the intersection of lines 16 and 17, which are repsectively, a first bisector 16 of the angle between the face of the tool lip and the surface to be worked and of a second bisector 17 of the angle between the face of the tool lip and the front face of the top iron. Therefore, by varying the position of the tool, the position of the centre of curvature 7 can be varied and thereby the radius of curvature of the path of the chip, and since said radius of curvature defines the length of the rive crack 5, also said length can be varied and set to a desired magnitude.

FIG. 2 also shows the situation with cutting tool 11*a* and top iron 20*a* in the O-position. In setting for the required chip thickness, the cutting tool 11*a* is adjusted from said zero position according to the path of adjustment 34, while the top iron 20*a* is adjusted along the path 41, during which the centre of curvature 7*a* moves along the line 23 toward point 7.

Figure 3:
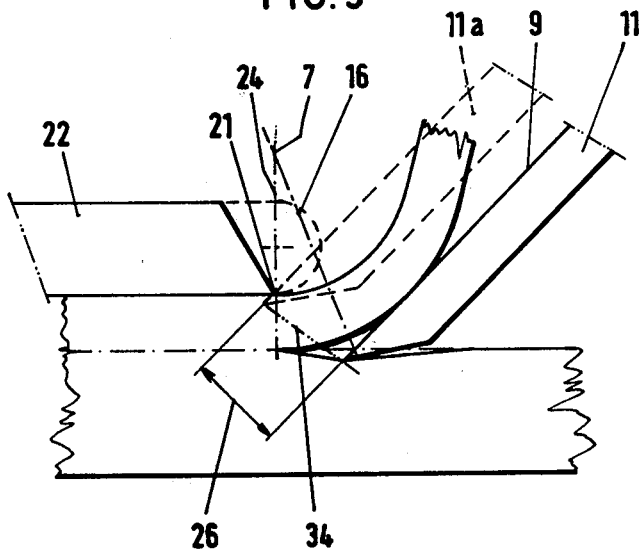

FIG. 3 indicates how use is made of a front table 22 as an aid for removing a chip. This may be a table having a sharp edge, but the front face of the table may also be rounded, e.g. by wear, as shown in the Figure by means of a broken line. The front table 22 is set to define a gap width 26, being the distance between the sharp-edged front table and the cutting face of the cutting tool 11. Also in such a method the centre of curvature of the path of the removed chip is fixed at a specific position of the aid. Critical here is the position of the front table edge 21, by means of which the length of the rive crack is defined. Said centre of curvature 7 lies on the intersection of the perpendicular 24 through the front table edge 21 and the bisector 16.

Figure 4:
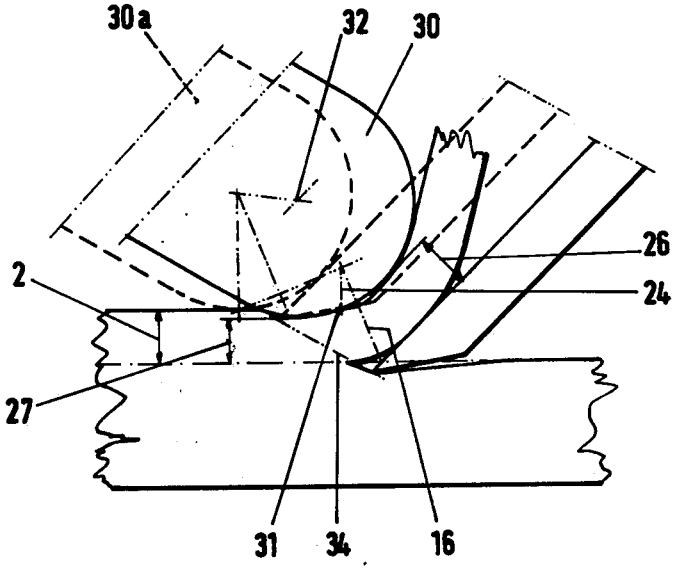

Instead of by means of a front table, the chip thickness may also be determined by means of a pressure bar 30 (see FIG. 4). The drawing shows a pressure bar with a circular cross-section in the region wherein it abuts against the chip, having a centre 32 (by 30*a* is indicated the pressure bar in the O-position). The smallest distance 27 between the outer surface of the pressure bar or block and the extension of the worked surface is smaller than the cutting depth 2. To avoid stripping up of the chip, the gap width 26 should at least be equal to the chip thickness 2. Here, too, the centre of curvature 7 is fixed, viz. on the intersection of the bisector 16 and the perpendicular 24 through the point of spring-back 31.

Both the setting of the top iron 20 (FIG. 2) and the setting of the front table or the pressure block in connection with the gap width for obtaining an optimal result is skilled work, for which steps the worker in the art usually resorts to his intuition.

By providing for such a coupling between the setting of the cutting tool and the setting of an aid, and a given ratio between the chip thickness and the associated radii of curvature, the paths of adjustment of the aids and of the cutting tool are fixed relative to each other, and the above mentioned difficult setting is avoided. FIGS. 2, 3 and 4 show that such a coupling can be realized, starting from a given starting situation, for instance wherein a chip is almost removed.

In FIG. 2 for example, by setting the cutting tool 11 for a greater cutting depth 2, at a ratio of the chip thickness to the maximum radius of curvature of 2:3, as shown, at a constant top iron angle $\phi$, the top iron should be set over a path of adjustment 41 along the face of the lip of the cutting tool. A mechanical coupling wherein, when setting for a specific chip thickness, the double iron is automatically adjusted in this manner, can be realized without much difficulty. The associated locus of the centres of curvature is shown at 23.

In the arrangement of FIGS. 3 and 4, at a given ratio between chip thickness and radii of curvature, a setting for a thicker chip involves a path of adjustment 34 of cutting tool 11. Essential in this respect is that said path of adjustment lies between the outer bisector of the angle between the sole of the front table 22 and the face of the tool 11*a* and the extension of the sole of the front table 22. Here, too, the path of adjustment is fixed in dependence on the depth of setting and therefore a mechanical coupling can be constructed. The centre of curvature than moves along the line of displacement 24. When using a pressure block according to FIG. 4, this applies analogously.

Figure 5:
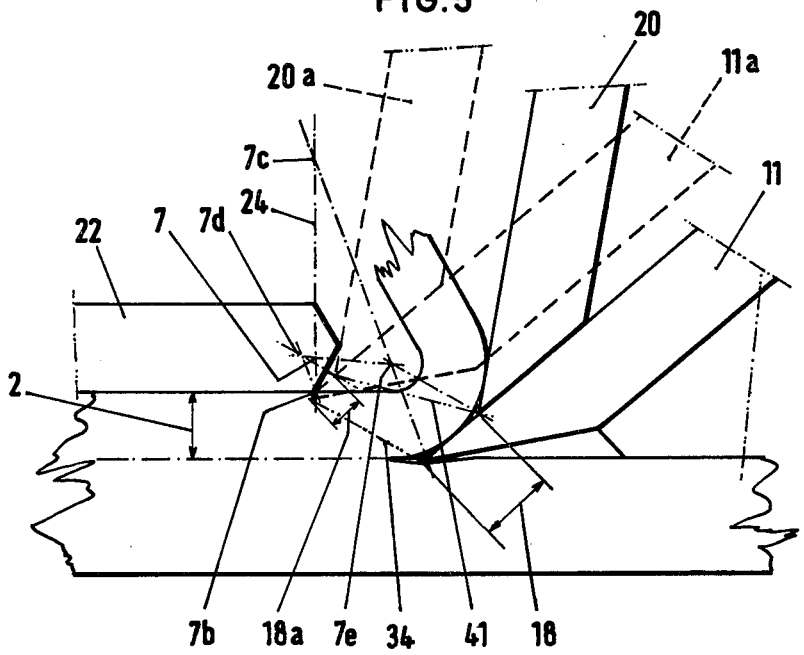
FIG. 5 diagrammatically shows a method of shaving, using a front table and a top iron as aids.

FIG. 5 diagrammatically shows the procedure when use is made of both a front table 22 and a top iron 20, 20*a*, the broken lines again indicating tool and top iron in the zero position, making allowance for a spring-back of the wood. In this case both the top iron and the front table play a role in the guiding of the chip. The respective paths of adjustments 34 and 41 of the tool and the top iron can be chosen so that at a given chip thickness, either the one aid or the other, or both equally define the chip form.

Generally speaking it may be stated that at a given setting of the aids, the aid giving rise to the smallest radius of curvature defines the chip form. In such a case the other aid may have a supporting task.

Tool 11, 11*a* is adjustble over path of adjustment 34 for removing chips having a thickness equal to zero to a maximum thickness 2. When traversing said path of adjustment 34, the centre of curvature of the removed chip shifts from point 7*b* along the line of displacement or locus 24 to point 7*c*. The path of adjustment 34 is so chosen that the gap width rapidly increases.

The path of adjustment 41 of the top iron is chosen for instance so that the free cutting face width 18*a*, 18 respectively, increases linearly with the chip thickness. When traversing said path of adjustment 41, the centre of curvature goes from point 7*d*—when the top iron is set against the front table edge, i.e. the zero position—towards point 7*e*, which corresponds with maximum chip thickness. Since, as indicated above, the smallest radius of curvature defines the path of the removed chip, the centre of curvature of the chip will traverse the path 7*b*-7-7*e* in the example shown, wherein tool and top iron respectively traverse the paths of adjustment 34 and 41 simultaneously, and wherein the respective lines of displacement intersect each other in point 7. It is mainly the front table edge that is operative over path 7*b*-7, while the top iron has a supporting function; the top iron is operative over the path 7-7*e*; and both are operative in point 7.

Whether there is a point of intersection 7 and if so, where this point is positioned precisely, depends on the chosen positioning of the top iron and the selected path of adjustment in combination with the rake angle of the cutting tool and the selected path of adjustment.

Figure 6:
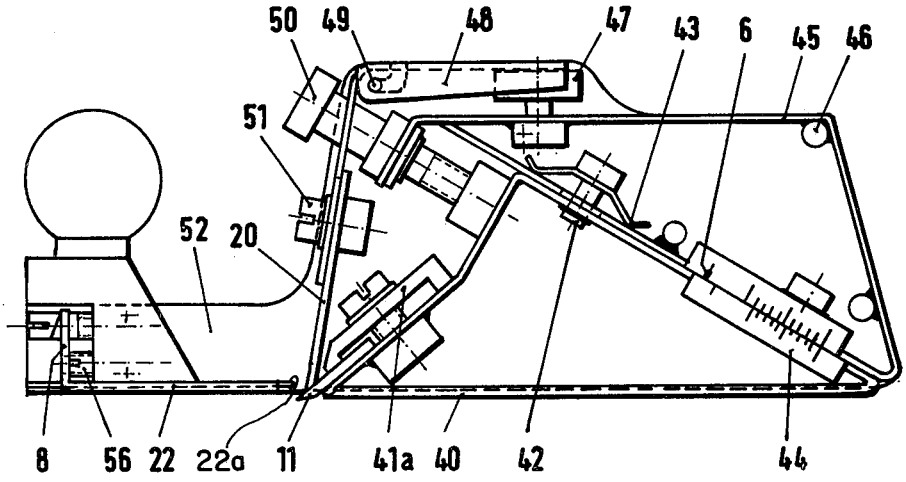
FIG. 6 is a longitudinal section of a block plane according to the invention.

The mechanical coupling between top iron and cutting tool may be realized in various manners, so that the required path of displacement for the centre of curvature is followed at varying chip thickness. A tool which is constructed so that the method illustrated in FIG. 5 can be carried out therewith, is shown in section in FIG. 6. In the block plane shown, 11 represents the cutting tool which is clamped on the front portion of the back table 40 by means of a strap 41*a*. The back table 40, which for instance is a triangular, bent sheet, rests against a reference surface of a rear block 45 which likewise may be such a bent sheet. The two are clamped against each other with a surface of the back table superimposed on the sliding reference surface of the back block by means of pins 42 with retaining clips 43. Rear block 45 is fitted by means of pins or bolts between two side plates 52 extending over the entire length of the plane as a frame thereof. Only the rear side plate is shown in the drawing. The back table 40 is guided by the side plates.

The sliding surface between back table 40 and rear block 45 has such an inclined position that the path of adjustment of tool 11 corresponds to the path of adjustment 34 shown in FIG. 5.

The setting is effected by means of a chip thickness setting bolt 50 which rotates in a lip or flange of rear block 45, and which coacts via very fine thread, i.e. having a very small pitch, with a thickened threaded portion on the back table 40.

The adjustment to clip thickness may be read on the vernier scale 44. When determining the zero position, allowance is made for the spring-back of the wood. The zero position setting is effected by means of marks 6.

The front table 22, which runs in two grooves in side plates 52, has an upturned lip or flange 8 with which two adjustment bolts 56 co-operate and a rear edge 22*a*.

A top iron 20 is attached to a tilting arm 48 by means of clamping bolts 51. Pivot pin 49 is supported in the side plates 52, e.g. in grooves perpendicular to the side plates.

When setting the chip thickness, the point of the top iron describes a circular path which corresponds to the path of adjustment 41 in FIG. 5. After the setting, the required clamping force of the top iron is obtained by securing clamping bolt 47. Since such a plane can be so easily set to different chip thicknesses, the use of more planes, for instance one for roughening and one for planing a thin chip, has become superfluous.

We claim:

1. In a planing apparatus for shaving chips off material to be planed, which apparatus includes a frame, a front table movably mounted on the frame and having a bottom surface (hereinafter designated "sole") and a rear edge thereof, a back table movably mounted on the frame and having a base surface generally parallel to said sole, and a cutting tool mounted to said back table, the cutting tool having a front face spaced from said rear edge of the front table defining a gap therebetween and having a cutting edge at its lower end, said front face defining a rake angle $\gamma$ with respect to a perpendicular plane through said sole, said front face of the cutting tool and said plane of the sole defining an oblique angle $\beta$ consisting of angle $\gamma+90°$, with a bisector of angle $\beta$ extending generally upward and an extension of said bisector (hereinafter designated "outer bisector") extending generally downward below the plane of said sole, the improvement in combination therewith for providing an optimal rive crack as chips are shaved, comprising:

(a) first means for adjusting the position of said cutting tool and thereby adjusting the cutting depth of said cutting edge relative to said sole from a reproducible zero-point to a selected cutting depth with said rake angle $\gamma$ being maintained essentially constant while said edge is displaceable along a first path located within an adjustment area which is defined within the acute angle formed by said outer bisector and a rearward extension of the plane of said sole, (b) a top iron movably mounted on said frame for abutting said front face of the cutting tool, the top iron having a lower edge spaced above the cutting edge of the cutting tool a variable distance defining between these two edges a free cutting face of the cutting tool, said top iron having a front surface which defines with said front face of the cutting tool a top iron angle $\phi$, and (c) second means for adjusting the position of said lower edge of the top iron along a second path which is chosen so that said angle $\phi$ remains essentially constant and said top iron remains adjacent the cutting tool.

2. Apparatus according to claim 1 wherein said second means provides movement of said top iron relative to said cutting tool, for thereby varying the length of said free cutting face of said cutting tool.

3. Apparatus according to claim 2 wherein said second means is coupled with said first means and provides said movement of said top iron simultaneously with adjustment by the first means of the position of the cutting tool, so that the center of curvature of the path traversed by the cut chips always lies on a line for causing an optimal rive crack associated with the respective chip thickness.

4. Apparatus according to claim 1 wherein said second means is coupled with said first means and provides adjustment of the position of said top iron simultaneously with adjustment by said first means of the position of said cutting tool, whereby the center of curvature of the path traversed by the cut chips always lies on a line for causing an optimal rive crack associated with the respective chip thickness.

5. Apparatus according to claim 1 wherein said first path is straight, concave, convex or a combination thereof.

6. In a planing apparatus for shaving chips off material to be planed, which apparatus includes, a frame with a front table part having a bottom surface (hereinafter designated "sole") and a rear edge thereof, a cutting tool movably mounted on the frame, the cutting tool having a front face spaced from said rear edge a distance designated "gap," a rear face, and a cutting edge at its lower end, said front face defining a rake angle $\gamma$ with respect to a perpendicular plane through the plane of said sole, said front face and said plane of said sole defining an oblique angle $\beta$ consisting of angle $\gamma+90°$, with a bisector of angle $\beta$ extending generally upward and an extension of said bisector (hereinafter designated "outer bisector") extending generally downward below the plane of said sole, the improvement in combination therewith comprising, a first means for adjusting the position of said cutting tool and thereby adjusting the cutting depth of said cutting edge relative to the plane of said sole from a reproducible zero-point to a selected cutting depth with said rake angle $\gamma$ being maintained essentially constant while said edge is displaceable along a first path located within an adjustment area which is defined within the acute angle formed by said outer bisector and a rearward extension of the plane of said sole, at least one aid selected from the group consisting of a movable top iron and a movable pressure bar, positionable for cooperation with said cutting tool and said sole, so that the center of curvature of the path traversed by the cut chips always lies on a line for causing an optimal rive crack associated with the respective chip thickness.

7. Apparatus according to claim 6 wherein said aid is a top iron movably mounted tp said frame for abutting said front face of the cutting tool, the top iron having a lower edge spaced above the cutting edge of the cutting tool a variable distance defining between these two edges a free cutting face of the cutting tool, said top iron having a front surface which defines with said front face of the cutting tool a top iron angle $\phi$, and second means for providing movement of said iron relative to the cutting tool for varying the length of said free cutting face while maintaining said angle $\phi$ essentially constant.

8. Apparatus according to claim 6 wherein said aid comprises a movable pressure bar formed by said rear edge of said sole and means for moving said rear edge for varying the distance of said gap.

9. Method of shaving chips off material to be planed with a planing apparatus which includes a frame having a front table part with a bottom surface (hereinafter designated "sole") and a rear edge thereof, and a cutting tool with front and rear faces and a cutting edge at its lower end, and at least one aid of the group consisting of a top iron and a pressure bar, the improvement comprising the steps of:

(a) positioning said cutting tool so that its front face defines a rake angle $\gamma$ with respect to a perpendicular plane through the plane of said sole, and said front face defines with said plane of said sole an oblique angle $\beta$ consisting of angle $\gamma+90°$, with a bisector of angle $\beta$ extending generally upward and an extension of said bisector (hereinafter designated "outer bisector") extending generally downward below the plane of said sole, and (b) adjusting the position of said cutting tool and thereby adjusting the cutting depth of said cutting edge relative to said plane of the sole from a reproducible zero-point to a selected cutting depth, by displacing said cutting edge along a first path located within an adjustment area which is defined within the acute angle formed by said outer bisector and a rearward extension of the plane of said sole while maintaining essentially constant said rake angle $\gamma$.

10. A method according to claim 9 wherein said aid is a top iron mounted to said frame for abutting said front face of the cutting tool, the top iron having a lower edge spaced above the cutting edge of the cutting tool a variable distance defining between these two edges a free cutting face of the cutting tool, said top iron having a front surface which defines with said front face of the cutting tool a top iron angle $\phi$, the method comprising the further step of adjusting the position of said top iron so that its lower edge is moved along a second path which is chosen so that said angle $\phi$ remains essentially constant and said top iron remains adjacent the cutting tool.

11. A method according to claim 10 wherein said further step comprises varying the length of said free cutting face.

12. A method according to claim 11 wherein said further step comprises adjusting the position of said top iron to vary the length of said free cutting face simultaneously with the step of adjusting the position of said cutting tool.

* * * * *